US007536119B2

(12) United States Patent
Choi

(10) Patent No.: US 7,536,119 B2
(45) Date of Patent: May 19, 2009

(54) IMAGE FORMING APPARATUS AND A METHOD THEREOF FOR SUPPLYING TONER

(75) Inventor: Jeong-jai Choi, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 341 days.

(21) Appl. No.: 11/148,189

(22) Filed: Jun. 9, 2005

(65) Prior Publication Data

US 2006/0018673 A1 Jan. 26, 2006

(30) Foreign Application Priority Data

Jul. 23, 2004 (KR) ..... 10-2004-0057774

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS

| | | | | |
|---|---|---|---|---|
| 4,270,487 | A * | 6/1981 | Terashima et al. | 399/63 |
| 6,118,951 | A * | 9/2000 | Kato et al. | 399/27 |
| 2004/0033083 | A1* | 2/2004 | Fukuyama et al. | 399/53 |
| 2005/0003292 | A1* | 1/2005 | Yamashita et al. | 430/111.33 |
| 2005/0064315 | A1* | 3/2005 | Yamaguchi et al. | 430/111.31 |
| 2005/0117919 | A1* | 6/2005 | Ito et al. | 399/27 |

FOREIGN PATENT DOCUMENTS

KR 2001-20965 3/2001

OTHER PUBLICATIONS

Patent Abstracts of Japan for Publication No. 06-348069, dated Dec. 22, 1994.
Patent Abstracts of Japan for Publication No. 07-234565, dated Sep. 5, 1995.
Patent Abstracts of Japan for Publication No. 2000-242070, dated Sep. 8, 2000.

* cited by examiner

*Primary Examiner*—David M Gray
*Assistant Examiner*—Ryan D Walsh
(74) *Attorney, Agent, or Firm*—Staas & Halsey LLP

(57) ABSTRACT

An image forming apparatus and method including a developing cartridge mounted in a main body of the image forming apparatus to receive a developer with a certain space occupancy of the developer with respect to an inner capacity thereof; a developer supply part connected to the developing cartridge to supply the developer; a sensor for detecting an amount of the developer in the developing cartridge; and a control part for controlling the developer supply part to restrict an amount of the developer for supply to the developing cartridge according to the amount of the developer detected by the sensor, thereby maintaining the space occupancy of the developer in the developing cartridge. Accordingly, the developer supplied to the developing cartridge can be in a certain range of space occupancy during printing, and as a result, density of the developer in a developing area can be uniform.

12 Claims, 6 Drawing Sheets

IMAGE FORMING APPARATUS AND A METHOD THEREOF FOR SUPPLYING TONER

CROSS-REFERENCE TO RELATED APPLICATIONS

This application claims the benefit of Korean Patent Application No. 2004-57774, filed Jul. 23, 2004, in the Korean Intellectual Property Office, the disclosure of which is incorporated herein by reference.

BACKGROUND OF THE INVENTION

1. Field of the Invention

The present invention relates to an image forming apparatus and method, and more particularly, to an image forming apparatus and method capable of obtaining an optimum amount of developer for a uniform density of the developer in a developing area and determining the optimum amount as a default value in order to provide optimum image quality.

2. Description of the Related Art

Generally, electrophotographic image forming apparatuses develop an electrostatic latent image formed on a photoconductive body into a visible image using a developer and transfer the visible image onto a printing medium, thereby printing a desired image. For the developer, a one-property developer that is non-magnetic and a two-property developer which is magnetic are generally used.

The two-property developer is a mixture of toner and carrier in a predetermined ratio. The carrier is attached on a surface of a developing sleeve by a magnetic force of the developing sleeve, and the toner is attached by surrounding static electricity.

FIG. 1 is a sectional view schematically showing the structure of a developing device of an image forming apparatus using the two-property developer.

Referring to FIG. 1, a developing device 10 comprises a housing 11, a developing roller 13, a developer mixing roller 17, a developer agitating screw 18 and a magnetic bar 19.

The housing 11 includes therein the developing roller 13 and the developer agitating screw 18, and has an opening 11*a* opposite to a photoconductive medium 20 so that the developing roller 13 and the photoconductive medium 20 face each other.

The developing roller 13 comprises a developing sleeve 14 and a fixing magnet 15. The developing sleeve 14 has a tubular form and is rotatably mounted in the housing 11. The developing sleeve 14 transfers a developer 1 to a developing area A, which is opposite to the photoconductive medium 20. The fixing magnet 15 is mounted within the developing sleeve 14 and has a tubular form divided into a plurality of sections. The fixing magnet 15 has a magnetic pole N1 opposite to the developing area A, and magnetic poles S1, N2, N3 and N2 are sequentially formed from the magnetic pole N1 counterclockwise, as shown in FIG. 1. In addition, a developer blade 16 is formed at a certain distance from one portion of the developing sleeve 14 in order to restrict thickness of the developer attached to the developing sleeve 14 to a certain degree.

The developer mixing roller 17 is disposed behind the developing sleeve 14 to evenly agitate two components of the developer 1, which are the toner and carrier, thereby frictionally electrifying the developer 1.

The developer agitating screw 18 is disposed behind the mixing roller 17 to supply the developer 1 to the developer mixing roller 17.

The magnetic bar 19 is disposed at upper and lower outsides of the opening 11*a* to adsorb the developer scattered in the developing area A.

Hereinbelow, the operation of the developing device 10 having the above structure will be described.

The developer 1 supplied to the housing 11 is supplied to the developer mixing roller 17 by the developer agitating screw 18, so that the toner and carrier are evenly mixed. The agitated developer 1 is attached to the developing sleeve 14 by a magnetic force of the fixing magnet 15 mounted inside the developing sleeve 14, thereby configuring a magnetic brush. As the developing sleeve 14 rotates, the developer 1 attached to the developing sleeve 14 is thinned to a certain thickness, passing through the developer blade 16.

When the developing sleeve 14 is located in the developing area A while rotating, the developer 1 thinned on a surface of the developing sleeve 14 is moved to the photoconductive medium 20 by static electricity of an electrostatic latent image of the photoconductive medium 20, thereby forming an electrostatic latent image. At this time, the developer 1 which is not electrified enough may be scattered without developing the electrostatic latent image. The scattered developer 1 is prevented by the magnetic bar 19 from being discharged out of the developing device 19.

However, such ability of the magnetic bar 19 that prevents scatter of the developer 1 is limited. Therefore, electrification of the developer 1 needs to be in a certain range in order to prevent scatter of the developer 1. Especially, since a consumed amount of the developer 1 per a unit time increases for a fast printing, the developer 1 should be promptly supplied, and also well mixed and agitated in a short time, so that the supplied developer 1 is uniformly electrified as a whole. However, if the developer 1 is excessively or insufficiently supplied, electrification of the developer 1 may be poorly performed, thereby deteriorating image quality or causing the scatter of the developer 1. As a result, a proper amount of the developer 1 for supply, for an optimum image quality, needs to be determined as a default value in an image forming apparatus.

SUMMARY OF THE INVENTION

An aspect of the present invention is to solve at least the above problems and/or disadvantages and to provide at least the advantages described below. Accordingly, an aspect of the present invention is to provide an image forming apparatus capable of obtaining an optimum amount of developer for a uniform density of the developer in a developing area and determining the optimum amount as a default value.

In order to achieve the above-described aspects of the present invention, there is provided an image forming apparatus including a developing cartridge mounted in a main body of the image forming apparatus to receive a developer with a certain space occupancy of the developer with respect to an inner capacity thereof; a developer supply part connected to the developing cartridge to supply the developer; a sensor for detecting an amount of the developer in the developing cartridge; and a control part for controlling the developer supply part to restrict an amount of the developer for supply to the developing cartridge according to the amount of the developer detected by the sensor, thereby maintaining the space occupancy of the developer in the developing cartridge.

The developing cartridge includes an agitating screw rotatably mounted to agitate the developer supplied from the developer supply part; a developer mixing roller mounted at one side of the agitating screw to agitate the developer together with the agitating screw; and a developing roller for developing the developer onto a photoconductive body.

The space occupancy refers to a ratio of a space occupied by the developer supplied to the developing cartridge with respect to the whole inner volume of the developing cartridge excluding spaces occupied by the agitating screw, the developer mixing roller and a developing roller.

The developer is a two-property developer in which a volume ratio of the toner with respect to the carrier is approximately 0.1~1.2% and/or a coverage of the developer is approximately 30~62%.

The sensor measures magnetic permeability of the developer in the developing cartridge and outputs the measured magnetic permeability as an electric signal.

The developer supply part includes a cartridge body for receiving the developer; at least one transfer medium pivotably mounted to the cartridge body to supply the developer to the developing cartridge; and a driving motor, being controlled by the control part, driving the transfer medium.

According to an embodiment of the present invention, the developer is a two-property developer wherein a carrier diameter R is 50 μm, a toner diameter is 5 μm, and a volume ratio of the toner with respect to the carrier is approximately 0.1%, and a diameter of the agitating screw is approximately 10 mm and a diameter of the developer mixing roller is approximately 35 mm.

According to a second embodiment of the present invention, the developer is a two-property developer wherein a carrier diameter R is 65 μm, a toner diameter is 7.5 μm, and a volume ratio of the toner with respect to the carrier is approximately 0.15%, and a diameter of the agitating screw is approximately 10 mm and a diameter of the developer mixing roller is approximately 35 mm.

According to a third embodiment of the present invention, the developer is a two-property developer wherein a carrier diameter R is 35 μm, a toner diameter is 8 μm, and a volume ratio of the toner with respect to the carrier is approximately 0.2%, and a diameter of the agitating screw is approximately 7.5 mm and a diameter of the developer mixing roller is approximately 20 mm.

According to a fourth embodiment of the present invention, the developer is a two-property developer wherein a carrier diameter R is 35 μm, a toner diameter is 8 μm, and a volume ratio of the toner with respect to the carrier is approximately 0.2%, and a diameter of the developer mixing roller is approximately 20 mm.

In order to achieve another aspect of the present invention, there is provided a method for supplying developer in an image forming apparatus, the method including the steps of supplying a developer into a developing cartridge; consuming the developer in the developing cartridge; and controlling an amount of the developer for supply, such that the developer maintains a predetermined space occupancy with respect to an inner volume of the developing cartridge.

The controlling step comprises the steps of setting a reference value of the space occupancy of the developer with respect to the inner volume of the developing cartridge; measuring the space occupancy of the developer in the developing cartridge; comparing the measured space occupancy with the reference value; and increasing the developer for supply if the measured space occupancy is less than the reference value.

The controlling step includes setting a reference value of the space occupancy of the developer with respect to the inner volume of the developing cartridge; measuring the space occupancy of the developer in the developing cartridge; comparing the measured space occupancy with the reference value; and decreasing the developer for supply if the measured space occupancy is equal to or greater than the reference value.

The developer is a two-property developer including magnetic carrier and toner mixed in a certain ratio, and the measuring step comprises the steps of detecting a magnetic permeability with respect to the developer in the developing cartridge using a magnetic permeability sensor; and converting the detected magnetic permeability to the space occupancy of the developer with respect to the inner volume of the developing cartridge.

The setting step sets a minimum L and a maximum H of the reference value. The minimum L is 55%, and the maximum H is 65%.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
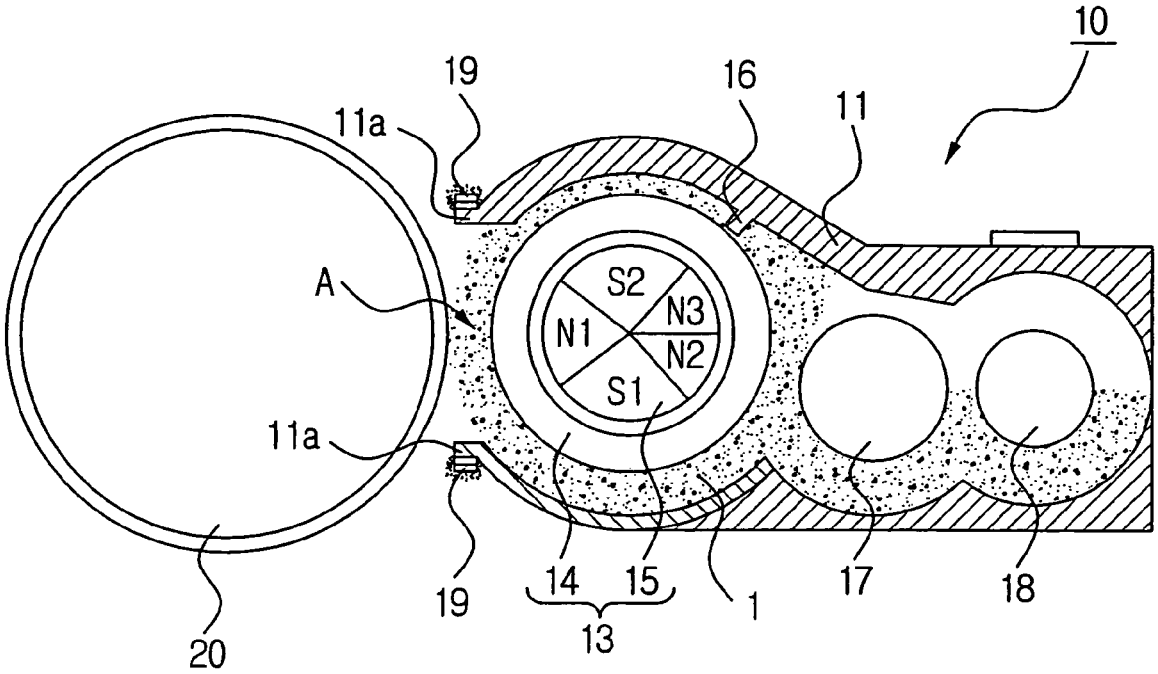
FIG. 1 (PRIOR ART)
FIG. 1 is a sectional view schematically showing the structure of a conventional developing device of an image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
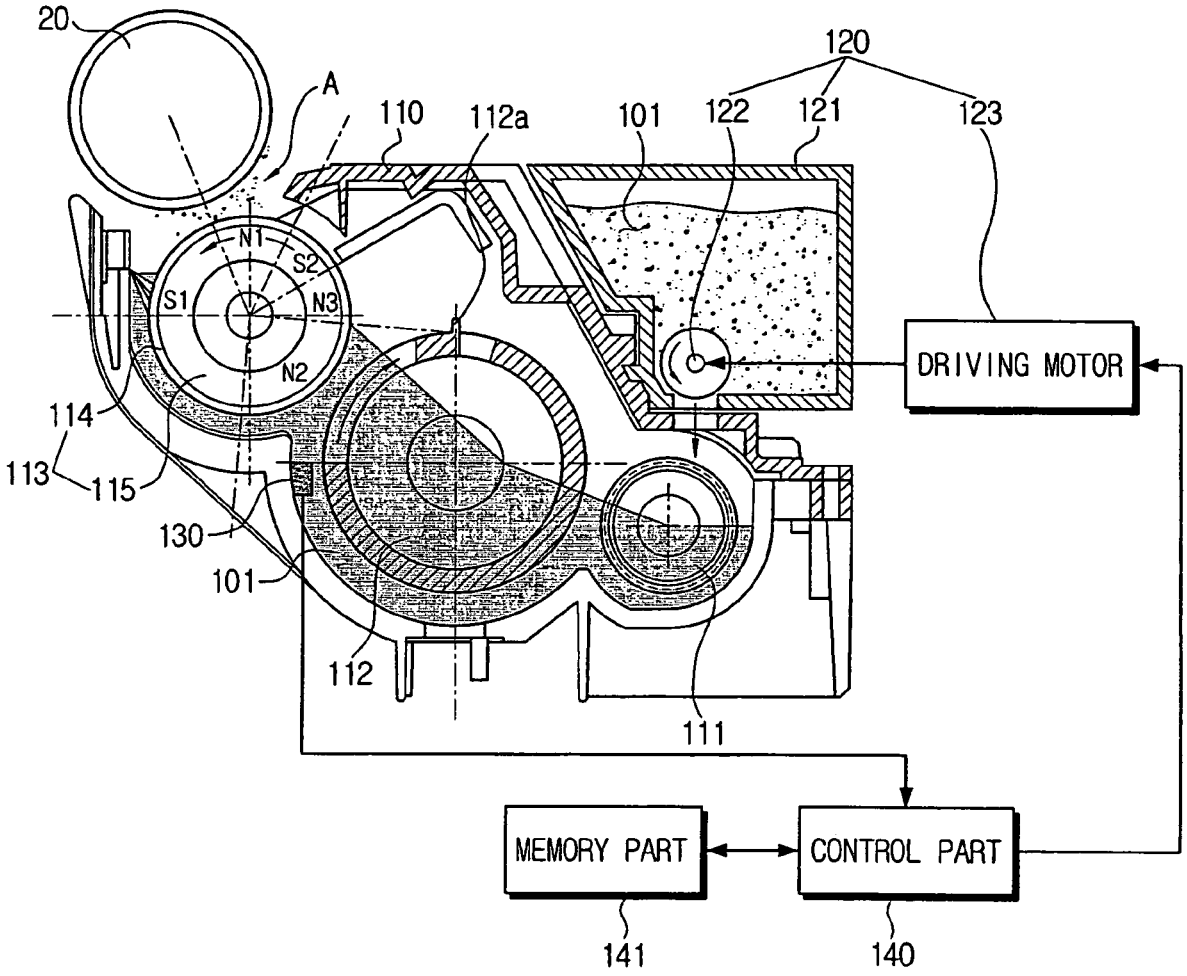
FIG. 2 is a sectional view schematically showing the structure of a developing device of an image forming apparatus, according to an embodiment of the present invention.

As shown in FIG. 2, a developing device for an image forming apparatus, according to an embodiment of the present invention, includes a developing cartridge 110, a developer supply part 120, a sensor 130 and a control part 140.

A developer 101 is supplied in the developing cartridge 110 to have predetermined space occupancy, and the developing cartridge 110 includes an agitating screw 111, a developer mixing roller 112 and a developing roller 113, which are all rotatably mounted.

Figure 3:
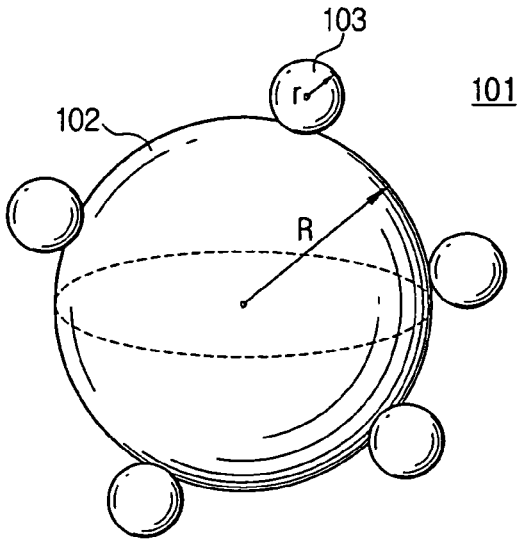
FIG. 3 is a conceptional view of a developer including a toner and a carrier.

The agitating screw 111 agitates the developer 101 supplied by the developer supply part 120 in the developing cartridge 110. As shown in FIG. 3, the developer 101 is a two-property developer wherein a plurality of toner 103 is attached to a carrier 102. A volume ratio of the toner 103 with respect to the carrier 102 is approximately 0.1~1.2%. Coverage of the developer 101 is approximately 30~62%. The coverage can be obtained by [Equation 1] as follows.

$$\text{Coverage (\%)}=\{\text{number of toner}\times\text{sectional area of toner/surface area of carrier}\}\times 100 \quad \text{[Equation 1]}$$

The developer mixing roller 112 is mounted at one side of the agitating screw 111. The developer mixing roller 112 transfers the developer 101 to an opposite direction to a transfer direction of the agitating screw 111, so that the developer 101 can be evenly mixed by the agitating screw 111. The developer mixing roller 112 has a plurality of developer supplying scoops 112*a* (FIG. 2) on an outer circumference thereof in order to supply the agitated developer 101 to the developing roller 113.

The developing roller 113 includes a developing sleeve 114 and a fixing magnetic 115.

The developing sleeve 114 is rotatably mounted at an upper portion of the developer mixing roller 112 to rotate in the same direction as the photoconductive medium 20, that is, counterclockwise with respect to FIG. 2, thereby transferring the developer 101 mixed by the developer mixing roller 112 to a developing area A formed between the developing sleeve 114 and the photoconductive medium 20.

The fixing magnet 115 is provided within the developing sleeve 114 to have magnetic poles of N1, S1, N2, N3 and S2 counterclockwise from the developing area A in sequence so as to transfer to the developing area A the developer 101 as being attached onto the developing sleeve 114.

The space occupancy of the developer 101 supplied to the developing cartridge 110 refers to a percentage of a space occupied by the developer 101 supplied to the developing cartridge 110 with respect to the whole inner volume of the developing cartridge 110 excluding spaces occupied by the agitating screw 111, the developer mixing roller 112 and a developing unit. Preferably, the space occupancy of the developer 101 is preset to approximately 55~65% and maintained in this range during the printing. A method for calculating the space occupancy will be described later.

The developer supply part 120 includes a cartridge body 121, a transfer medium 122 and a driving motor 123. The cartridge body 121 accommodates the developer 101 therein. The transfer medium 122 is pivotally mounted to the cartridge body 121 to supply the developer 101 to the developing cartridge 110. The driving motor 123, being controlled by the control part 140, drives the transfer medium 122.

The sensor 130 may be implemented by a magnetic sensor that measures a magnetic permeability denoting a magnetic change of the developer 101 supplied to the developing cartridge 110, and transmits the magnetic permeability to the control part 140.

As shown in FIG. 2, the control part 140 is connected to a certain memory part 141 to maintain the space occupancy of the developer 101 supplied to the developing cartridge 110 in a predetermined range by a reference value stored to the memory part 141. The preset value stored to the memory part 141 includes physical information such as a volume of the developing cartridge 110, and a property of the developer 101. The control part 140 calculates an amount of the developer 101 supplied to the developing cartridge 110 using the magnetic permeability measured by the sensor 130 and accordingly calculates the space occupancy of the developer 101 in the developing cartridge 110 at a time point of sensing by the sensor 130. The control part 140 compares the calculated space occupancy with the reference value and controls the amount of the developer 101 for supply to the developing cartridge 110, such that the space occupancy can be maintained in the certain range. The above processes will be described in greater detail hereinbelow in explaining a method for supplying the developer 101.

Figure 4:
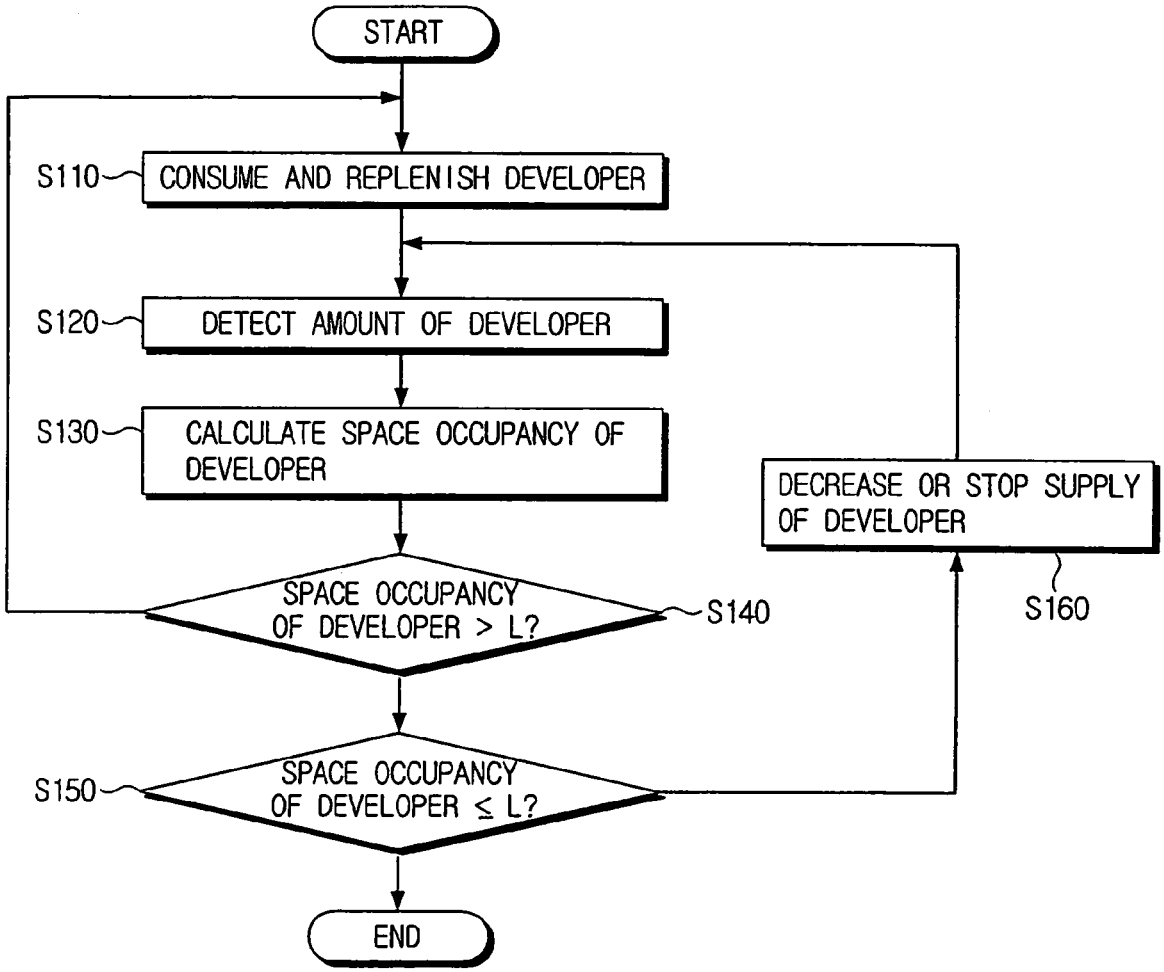
FIG. 4 is a flow chart illustrating a method for supplying a developer for an image forming apparatus according to an embodiment of the present invention.

Hereinbelow, a method for supplying the developer 101 in an image forming apparatus, according to an embodiment of the present invention, will be described with reference to FIGS. 2 to 4.

In the developing cartridge 110 according to an embodiment of the present invention, the space occupancy of the developer 101 supplied to the developing cartridge 110 is preset to a predetermined default value, and the default value is stored to the memory part 141. Preferably, the space occupancy of the developer 101 is preset to approximately 55~65%. As the printing work begins, the developer 101 is supplied from the developer supply part 120 to the developing cartridge 110 corresponding to an amount of the developer 101 consumed for printing (S110).

After the developer 101 is replenished, the sensor 120 detects the magnetic permeability of the developer 101 in the developing cartridge 110 and transmits the detection result to the control part 140. The magnetic permeability, also referred to as magnetic induction, denotes a ratio of strength of magnetic field in vacuum with respect to a magnetic flux density generated by magnetization of the magnetic field. Therefore, the control part 140 compares a reference value which is magnetic permeability generated in a certain volume of the developer 101 with the magnetic permeability detected by the sensor 130, thereby calculating the amount of the developer 101 in the developing cartridge 110 (S120).

The memory part 141 stores a reference space occupancy of the developer 101 as a default value and a maximum suppliable volume of the developer 101, which is obtained by subtracting volume of the agitating screw 111, the developer mixing roller 112 and the developing roller 113 from the whole inner volume of the developing cartridge 110. The control part 140 converts the maximum suppliable volume stored to the memory part 141 and the calculated amount of the developer 101 in step S120 into volume, and accordingly calculates current space occupancy. The space occupancy is a percentage of the space occupied by the developer 101 with respect to the maximum suppliable volume (S130).

After the space occupancy is calculated in step S130, the control part 140 compares the calculated space occupancy with the reference space occupancy stored to the memory part 141. Preferably, a maximum H of the space occupancy of the developer 101 is approximately 65%, and a minimum L is approximately 55%. First, it is determined whether the calculated space occupancy is equal to or more than the minimum L, such that the developer 101 is additionally supplied to the developing cartridge 110 in the next step of printing if the space occupancy is less than the minimum L (S140).

When the space occupancy calculated in step S140 is equal to or more than the minimum L, the space occupancy is compared to the maximum H (S150).

If the space occupancy of the developer 101 is greater than the maximum H, the amounted of the developer 101 to be supplied to the developing cartridge 110 in the next step of printing may be decreased, or supply of the developer 101 may be suspended (S160).

The control part 140 controls the driving motor 123 of the developing supply part 120 in order to control the amount of the developer 101 supplied to the developing cartridge 110, during steps S140 to S160.

Hereinbelow, it will be experimentally proved that optimum developer distribution uniformity, agitating efficiency and electrifying efficiency can be guaranteed when the space occupancy of the developer 101 in the developing cartridge 110 is approximately 55%~65%. Conditions of the experiment are as follows. In a developer sample A, a toner diameter r is 5 μm, a carrier diameter R is 50 μm, and a volume ratio of the toner with respect to the carrier is approximately 0.1%. In a developer sample B, a toner diameter r is 7.5 μm, a carrier diameter R is 65 μm, and a volume ratio of the toner with respect to the carrier is approximately 0.15%. In a developer sample C, a toner diameter r is 8 μm, a carrier diameter R is 35 μm, and a volume ratio of the toner with respect to the carrier is approximately 0.2%.

Figure 5:
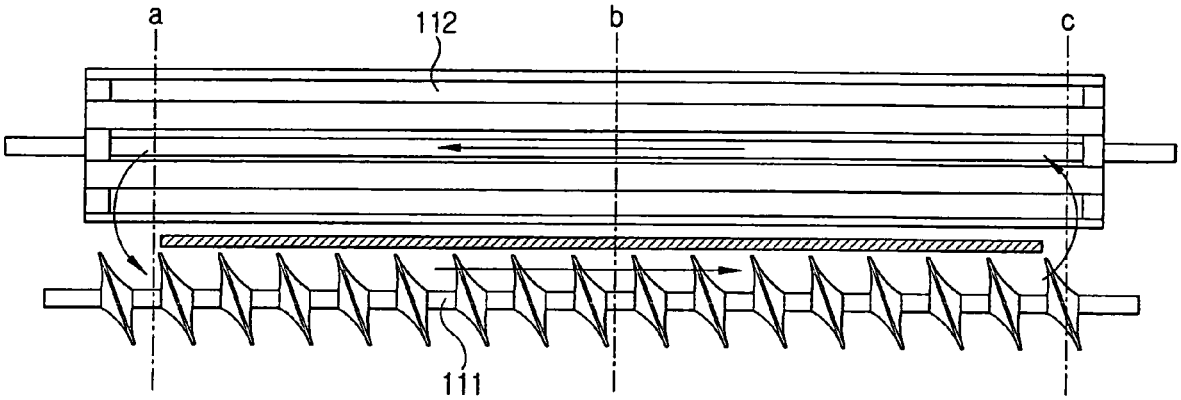
FIG. 5 schematically shows only an agitating screw and a developer mixing roller of the developing device according to an embodiment of the present invention.

FIG. 5 schematically illustrates the agitating screw 111 and the developer mixing roller 112 of the developing device according to an embodiment of the present invention. As shown in FIG. 5, the developer 101 proceeds in an arrowed direction by the agitating screw 111. The developer mixing roller 112 transfers the developer 101 to the opposite direction to the agitating screw 111, so that the agitated developer 101 is not inclined to one sidewall of the developing cartridge 110 but evenly circulated within the developing cartridge 110. In FIG. 5, reference numerals a, b and c denote measuring positions for comparing physical properties of the developer 101.

Results of the experiment are illustrated in Tables 1 to 3 as below. A mark 'o' refers to a high uniformity a mark 'x' a low uniformity, and a mark 'Δ' a normal uniformity. This experiment is to confirm whether the developer 101 has uniform distribution by the agitating screw 111 and the developer mixing roller 112 as increasing the space occupancy of the developer samples A to C by 5% increments from 40%.

TABLE 1

| | Position | | | |
|---|---|---|---|---|
| | [%] | a | b | C |
| Sample A space occupancy of developer | 40 | x | x | x |
| | 45 | x | x | x |
| | 50 | Δ | Δ | x |
| | 55 | Δ | ○ | ○ |
| | 60 | Δ | ○ | ○ |
| | 65 | ○ | ○ | ○ |
| | 70 | ○ | x | x |
| | 75 | Δ | x | x |

TABLE 2

| | Position | | | |
|---|---|---|---|---|
| | [%] | a | b | C |
| Sample B space occupancy of developer | 40 | x | x | x |
| | 45 | x | x | x |
| | 50 | x | x | x |
| | 55 | Δ | ○ | ○ |
| | 60 | Δ | ○ | ○ |
| | 65 | ○ | Δ | ○ |
| | 70 | Δ | x | Δ |

TABLE 2-continued

| | Position | | | |
|---|---|---|---|---|
| | [%] | a | b | C |
| | 75 | x | x | x |

TABLE 3

| | Position | | | |
|---|---|---|---|---|
| | [%] | a | b | C |
| Sample C space occupancy of developer | 40 | x | x | x |
| | 45 | x | x | x |
| | 50 | x | x | x |
| | 55 | Δ | ○ | Δ |
| | 60 | Δ | ○ | ○ |
| | 65 | ○ | ○ | Δ |
| | 70 | Δ | x | Δ |
| | 75 | x | x | x |

As a result of the experiment, within a range of approximately 55%~65% of the space occupancy of the developer 101, uniformity of the developer 101 supplied into the developing cartridge 110 is optimum.

Figure 6:
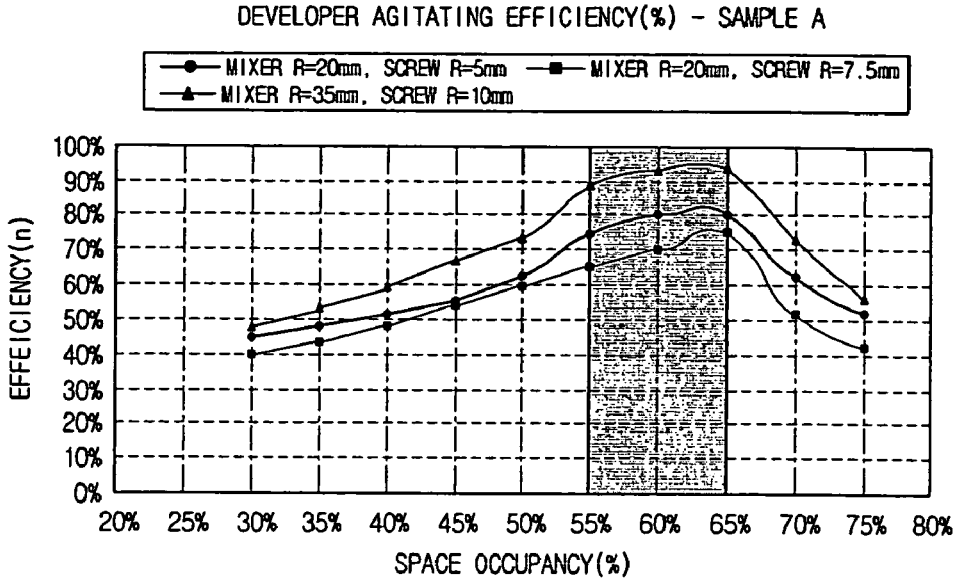
FIG. 6 to FIG. 8 are graphs illustrating a developer agitation efficiency according to space occupancy of developer samples A to C.
Figure 7:
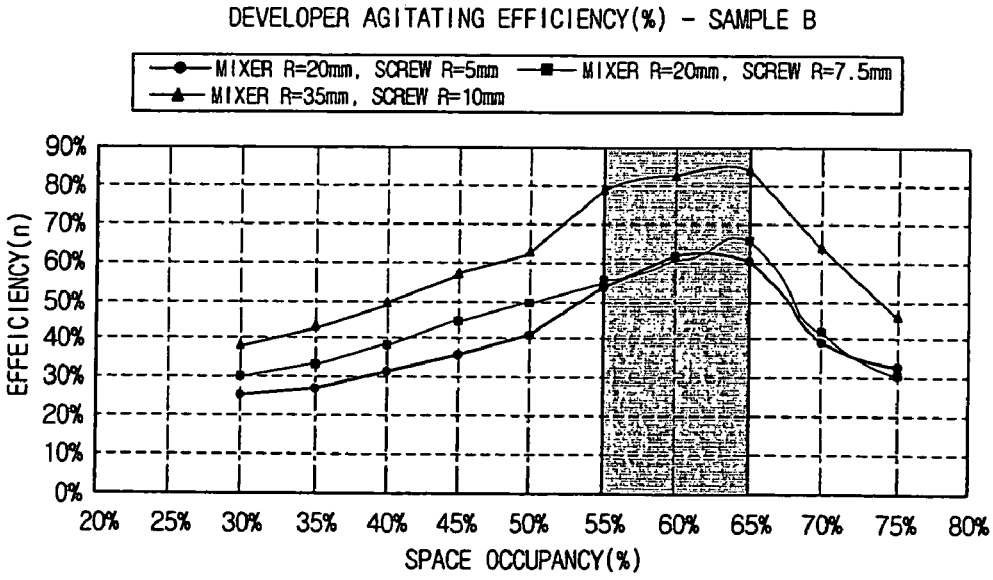

Additionally, an experiment for measuring an agitating efficiency is conducted using the developer samples A to C having the above-described properties and changing a diameter of the developer mixing roller 112 to 20 mm, 25 mm and 35 mm, and a diameter of the agitating screw 111 to 5 mm, 7.5 mm and 10 mm, respectively. FIGS. 6 and 7 show the results of the experiment for measuring the agitating efficiency according to the space occupancy of the developer 101. In this experiment, the space occupancy of the developer 101 is increased by 5% increments from 30% to 75%.

As a result of the experiment, as shown in FIGS. 6 and 7, the developer samples A and B show the optimum agitating efficiency, that is, at least 90%, when the space occupancy is approximately 55%~65%. Here, the diameter of the developer mixing roller 112 is 35 mm, and the diameter of the agitating screw 111 is 10 mm.

Figure 8:
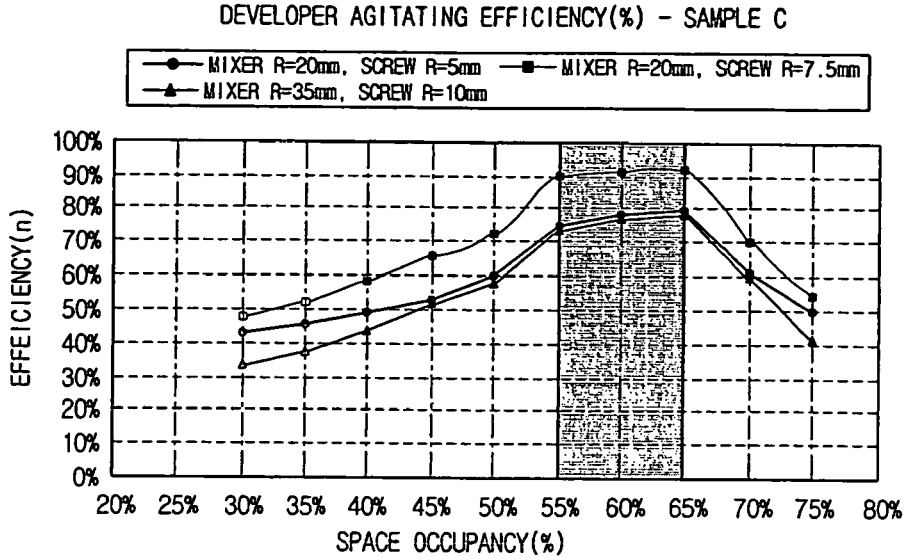

FIG. 8 is a graph showing the result of the agitating efficiency of the developer sample C. The developer sample C also shows the optimum agitating efficiency, that is, at least 90%, when the space occupancy is approximately 55%~65%. Here, the diameter of the developer mixing roller 112 is 20 mm, and the diameter of the agitating screw 111 is 7.5 mm.

Figure 9:
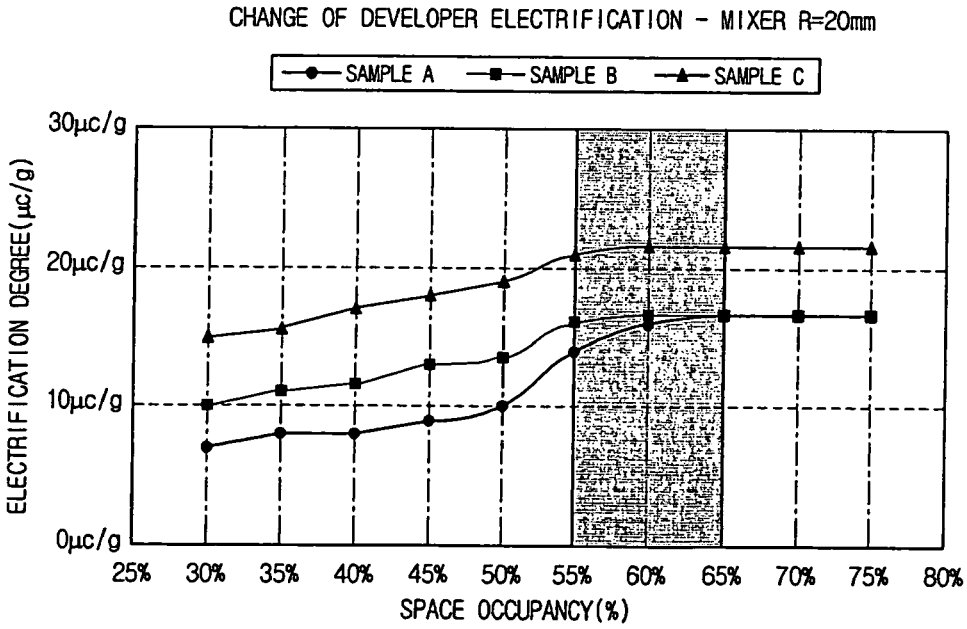
FIG. 9 is a graph illustrating a change of developer electrification according to space occupancy of developer samples A to C.

FIG. 9 illustrates a result of an experiment measuring changes of electrifying efficiency of the developer 101 by increasing the space occupancy of the developer samples A to C by 5% from 30% to 75%. For this experiment, the diameter of the developer mixing roller 112 is 20 mm. As a result of the experiment, each developer sample shows a proper degree of electrification when the space occupancy of the developer 101 is approximately 55%~65%. Especially, the developer sample C shows the most superior electrifying efficiency, in which the carrier diameter R is 35 μm, the toner diameter is 8 μm, and a volume ratio of the toner with respect to the carrier is 0.2%.

As can be appreciated from the above experiments, by setting the space occupancy of the developer 101 for supply to the developing cartridge 110 to be approximately 55%~65% as a default value and maintaining the space occupancy, the distribution efficiency, the agitating efficiency and the electrifying efficiency of the developer 101 supplied to the developing cartridge 110 can be improved.

According to an embodiment of the present invention, since the amount of the developer 101 supplied to the developing cartridge 110 during the printing work is restricted to maintain the space occupancy of a certain range, density of the developer 101 in the developing area A can be uniform.

While the invention has been shown and described with reference to certain embodiments thereof, it will be understood by those skilled in the art that various changes in form and details may be made therein without departing from the spirit and scope of the invention as defined by the appended claims.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus including a main body and comprising:

a developing cartridge mounted in the main body of the image forming apparatus to receive a developer in accordance with a certain space occupancy of the developer with respect to an inner capacity thereof;

a developer supply part connected to the developing cartridge to supply the developer;

a sensor detecting an amount of the developer in the developing cartridge; and a control part controlling the developer supply part to restrict an amount of the developer to supply to the developing cartridge according to the amount of the developer detected by the sensor, thereby maintaining the space occupancy of the developer in the developing cartridge, wherein the developing cartridge comprises an agitating screw rotatably mounted to agitate the developer supplied from the developer supply part, a developer mixing roller mounted at one side of the agitating screw to agitate the developer together with the agitating screw and a developing roller for developing the developer onto a photoconductive body, the space occupancy includes a ratio of a space occupied by the developer supplied to the developing cartridge with respect to the whole inner volume of the developing cartridge excluding spaces occupied by the agitating screw, the developer mixing roller and a developing roller, and the space occupancy of the developer is approximately 55~65%.

2. The image forming apparatus of claim 1, wherein the developer mixing roller includes a plurality of developer supplying scoops disposed along an outer circumference.

3. The image forming apparatus of claim 1, wherein the developing roller comprises:

a developing sleeve; and a fixing magnet.

4. The image forming apparatus of claim 1, wherein the sensor measures magnetic permeability of the developer in the developing cartridge and outputs the measured magnetic permeability as an electric signal.

5. The image forming apparatus of claim 1, wherein the developer supply part comprises:

a cartridge body for receiving the developer;

at least one transfer medium pivotally mounted to the cartridge body to supply the developer to the developing cartridge; and a driving motor, being controlled by the control part, driving the transfer medium.

6. The image forming apparatus of claim 1, wherein the developer is a two-property developer wherein a carrier diameter R is 35 μm, a toner diameter is 8 μm, and a volume ratio of the toner with respect to the carrier is approximately 0.2%, and a diameter of the agitating screw is approximately 7.5 mm and a diameter of the developer mixing roller is approximately 20 mm.

7. The image forming apparatus of claim 1, wherein the developer is a two-property developer wherein a carrier diameter R is 35 μm, a toner diameter is 8 μm, and a volume ratio of the toner with respect to the carrier is approximately 0.2%, and a diameter of the developer mixing roller is approximately 20 mm.

8. An image forming apparatus including a main body and comprising:

a developing cartridge mounted in the main body of the image forming apparatus to receive a developer in accordance with a certain space occupancy of the developer with respect to an inner capacity thereof;

a developer supply part connected to the developing cartridge to supply the developer;

a sensor detecting an amount of the developer in the developing cartridge; and a control part controlling the developer supply part to restrict an amount of the developer to supply to the developing cartridge according to the amount of the developer detected by the sensor, thereby maintaining the space occupancy of the developer in the developing cartridge, wherein the developing cartridge comprises an agitating screw rotatably mounted to agitate the developer supplied from the developer supply part, a developer mixing roller mounted at one side of the agitating screw to agitate the developer together with the agitating screw and a developing roller for developing the developer onto a photoconductive body, the developer is a two-property developer wherein a carrier diameter R is 50 μm, a toner diameter is 5 μm, and a volume ratio of the toner with respect to the carrier is approximately 0.1%, and a diameter of the agitating screw is approximately 10 mm and a diameter of the developer mixing roller is approximately 35 mm.

9. An image forming apparatus including a main body and comprising:

a developing cartridge mounted in the main body of the image forming apparatus to receive a developer in accordance with a certain space occupancy of the developer with respect to an inner capacity thereof;

a developer supply part connected to the developing cartridge to supply the developer;

a sensor detecting an amount of the developer in the developing cartridge; and a control part controlling the developer supply part to restrict an amount of the developer to supply to the developing cartridge according to the amount of the developer detected by the sensor, thereby maintaining the space occupancy of the developer in the developing cartridge, wherein the developing cartridge comprises an agitating screw rotatably mounted to agitate the developer supplied from the developer supply part, a developer mixing roller mounted at one side of the agitating screw to agitate the developer together with the agitating screw and a developing roller for developing the developer onto a photoconductive body, the developer is a two-property developer wherein a carrier diameter R is 65 μm, a toner diameter is 7.5 μm, and a volume ratio of the toner with respect to the carrier is approximately 0.15%, and a diameter of the agitating screw is approximately 10 mm and a diameter of the developer mixing roller is approximately 35 mm.

10. A method for supplying developer in an image forming apparatus, the method comprising:

supplying a developer into a developing cartridge;

consuming the developer in the developing cartridge; and controlling an amount of the developer for supply, such that the developer maintains a predetermined space occupancy with respect to an inner volume of the developing cartridge, wherein the controlling comprises setting a reference value of the space occupancy of the developer with respect to the inner volume of the developing cartridge, measuring the space occupancy of the developer in the developing cartridge, comparing the measured space occupancy with the reference value and increasing the developer for supply if the measured space occupancy is less than the reference value, and the setting step sets a minimum L and a maximum H of the reference value, and the minimum L is 55%, and the maximum H is 65%.

11. The method of claim 10, wherein the controlling comprises:

setting a reference value of the space occupancy of the developer with respect to the inner volume of the developing cartridge;

measuring the space occupancy of the developer in the developing cartridge;

comparing the measured space occupancy with the reference value; and decreasing the developer for supply if the measured space occupancy is equal to or greater than the reference value.

12. The method of claim 10, wherein the developer is a two-property developer comprising magnetic carrier and toner mixed in a certain ratio, and the measuring step comprises:

detecting a magnetic permeability with respect to the developer in the developing cartridge using a magnetic permeability sensor; and converting the detected magnetic permeability to the space occupancy of the developer with respect to the inner volume of the developing cartridge.

* * * * *